US006805241B2

(12) United States Patent
Smith

(10) Patent No.: US 6,805,241 B2
(45) Date of Patent: Oct. 19, 2004

(54) PROTECTIVE PACKAGING DEVICE HAVING MULTIPLE DEFLECTION ELEMENTS

(76) Inventor: Forrest Smith, 427½ Larkspur Ave., Corona del Mar, CA (US) 92625

( * ) Notice: Subject to any disclaimer, the term of this patent is extended or adjusted under 35 U.S.C. 154(b) by 182 days.

(21) Appl. No.: 10/247,701

(22) Filed: Sep. 20, 2002

(65) Prior Publication Data

US 2004/0055929 A1 Mar. 25, 2004

(51) Int. Cl.[7] ..... B65D 81/02
(52) U.S. Cl. ..... 206/592; 206/594
(58) Field of Search ..... 206/521, 586, 206/588, 591, 592, 594, 722, 723, 724

(56) References Cited

U.S. PATENT DOCUMENTS

| | | | | |
|---|---|---|---|---|
| 2,874,826 A | | 2/1959 | Matthews et al. | |
| 3,294,223 A | | 12/1966 | Goban | |
| 3,938,661 A | * | 2/1976 | Carmody | 206/253 |
| 4,905,835 A | | 3/1990 | Pivert et al. | |
| 5,226,543 A | | 7/1993 | Foos et al. | |
| 5,259,508 A | * | 11/1993 | Beckerman | 206/587 |
| 5,385,232 A | | 1/1995 | Foos et al. | |
| 5,515,976 A | | 5/1996 | Moren et al. | |
| 5,626,229 A | | 5/1997 | Dickie et al. | |
| 5,628,402 A | | 5/1997 | Dickie et al. | |
| 5,706,951 A | * | 1/1998 | Oinuma et al. | 206/710 |
| 5,799,796 A | | 9/1998 | Azelton et al. | |
| 6,123,200 A | * | 9/2000 | Stephens et al. | 206/592 |
| 6,398,029 B1 | | 6/2002 | Farison et al. | |

FOREIGN PATENT DOCUMENTS

FR 2 809 091 A1 11/2001

* cited by examiner

*Primary Examiner*—Jacob K. Ackun, Jr.
(74) *Attorney, Agent, or Firm*—Cahn & Samuels, LLP

(57) ABSTRACT

A protective packaging device for a shock sensitive product being shipped or stored in a rectilinear outer packaging container comprises a product receiving cavity having product contacting walls and a product supporting platform. A base portion located below the product receiving cavity has two pairs of deflection elements extending diagonally away from the corners of the cavity towards external outer packaging container contacting corners, and bottom outer packaging container contacting lips at the bottom of the base portion. The distances between adjacent pairs of outer packaging container contacting corners are substantially equal to the internal distances between adjacent pairs of corners of the outer packaging container. The deflection elements are adapted to flex away one from another, and the bottom outer packaging container contacting lips are adapted to spread away from one another, under shock loading conditions. Thus, shock protection is provided in three mutually perpendicular directions.

11 Claims, 2 Drawing Sheets

PROTECTIVE PACKAGING DEVICE HAVING MULTIPLE DEFLECTION ELEMENTS

FIELD OF THE INVENTION

This invention relates to product cushioning devices for use in packaging shock sensitive products. In particular, the invention relates to re-usable or recyclable product cushioning devices which are made from plastics material, and which are particularly intended for use with shock sensitive products such as computer components—particularly hard drives, CD and DVD drives, and the like. The configuration of cushioning devices in keeping with the present invention is typically as an end cap. Product cushioning structures in keeping with the present invention comprise unitary structures which may be molded from a suitable plastic material, using a thermoforming molding techniques.

BACKGROUND OF THE INVENTION

The use of product cushioning devices for shock sensitive products has been known for many years. Typically, cushioning for shock sensitive devices comprises a number of different approaches, each of which may have its own particular advantages and/or disadvantages.

For example, it has been known for many years to wrap shock sensitive or delicate devices or merchandise in tissue paper, and to cushion the products with loosely balled tissue paper. Another use of paper has been shredded paper, or excelsior. A more elegant approach has been to use bubble-pack, which comprises a sheet material having a plurality of contained bubbles of air formed therein. Another approach which has been used for many years has been the use of a plurality of discrete molded foamed polystyrene pellets, sometimes referred to as "peanuts" in the industry, to fill around a product in a container.

As the requirement for better packaging and cushioning became more demanding, for example with the introduction to the market of complicated and expensive electronics devices such as computer monitors, and more particularly notebook computers, printed circuit boards, and the like, the requirement arose for more sophisticated and better shock absorbing cushioning devices. Standards were developed for acceptance of cushioning devices, including drop tests and the like, to determine if such devices would protect the shock sensitive product from shock acceleration greater than the product's fragility level—typically, from 20 g's to 100 g's.

This has given rise to the use of such products as honeycomb cardboard, and particularly foamed polystyrene, foamed polyurethane, foamed polypropylene, or foamed polyethylene. Flexible foam devices are well known for use as corner pieces or edge pieces. Likewise, foamed polystyrene products—which are more rigid—are also well known for use as corner pieces or end caps; and very often, they are product specific in that they are particularly molded having a specific configuration for use with a particular product.

In general, however, flexible foam cushioning devices, and foamed polystyrene cushioning devices, are not recyclable. There are several reasons for that condition: The first is that flexible foam cushioning devices, and polystyrene cushioning devices, tend to be quite bulky, and are usually discarded with the packaging container in which the product has been shipped. There are very few specific recycling depots that are set up for either flexible foam or especially polystyrene cushioning devices; and, in any event, foamed polystyrene and foamed polyurethane cannot generally be recycled. Its re-usability may be provided for, particularly as general corner pieces, if they remain intact, or as product specific end caps; but, unless such foamed polystyrene cushioning devices are being used in a closed shipping system, they will not be recovered for re-use. Moreover, foamed polystyrene cushioning devices tend to be very frangible, and do not maintain their integrity very well once they have been used and removed from the packaging container in which they are shipped.

More elegant cushioning devices have more recently entered the market, comprising different types of blow-molded or other plastics shell products, most of which are closed structures which are filled with air or other gas. Some such structures are inflatable, some are closed, and some may be open to the atmosphere but are formed of a relatively rigid material. All such products are generally formed from high density polyethylene, which may be recycled because it is easily chopped up and made into further products, or such products may be re-usable if they are employed in a closed delivery and recovery system. Low density polyethylene may also be found in products such as those described immediately above, although its use is quite limited at the present time.

Very often, computer components such as hard drives or CD or DVD drives, or resellers of the same, wish to package such shock sensitive devices individually in outer packaging containers. That is to say, these shock sensitive devices are packaged and shipped, or stored, in individual outer boxes. At the same time, however, it is not desired to employ excessive packaging materials such as those that are spoken of above. Accordingly, the present invention provides an end cap which may be placed at both ends of such shock sensitive devices, where the dimensions of the end cap, particularly in the base portion thereof, are such that the end cap fits intimately into an individual outer box; and the end cap has a product receiving recess or cavity such that the shock sensitive device may be received intimately into that cavity.

Thus, it can be appreciated that by employing a pair of end caps in keeping with the present invention, shock protection for individually packaged shock sensitive devices such as computer hard drives, CD or DVD drives, or the like, may be provided.

DESCRIPTION OF THE PRIOR ART

U.S. Pat. No. 2,874,826 issued to MATTHEWS et al. is directed to a shock and vibration isolation device which, however, is not intended for being incorporated in a rectilinear container. Rather, this device is a resilient and inflatable jacket comprising a plurality of chambers, made of a rubberized fabric which is adapted to hold a gas under pressure, and which will be wrapped around a shock sensitive device such as a guided missile so as to provide a shock and vibration isolation container therefor.

GOBAN U.S. Pat. No. 3,294,223 teaches a molded plastic corner piece having the configuration of a triangular polyhedron which is either rounded or flattened at its apex. The purpose of the corner support is to entrap air between the molded plastic corner piece and the corner of the carton into which it is placed.

U.S. Pat. No. 4,905,835 issued to PIVERT et al. teaches inflatable cushion packaging wherein a plurality of chambers are inflated so as to provide cushioning which will absorb shock and thereby protect a shock sensitive product located in the centre of the container. The amount to which the balloon-like chambers may be inflated, and therefore their hardness, may be controlled.

FOOS et al. U.S. Pat. No. 5,226,543 teaches a packaging structure which includes both a platform portion and a sidewall portion, wherein the sidewall portion forms an enclosure around the platform portion. Essentially, this product is an end cap or platform. The sidewall has both inner and outer walls which are joined by a bridge section, and the inboard wall is relatively shorter than the outboard wall such that the platform portion holds the fragile article at a specific distance above the lower edge of the outboard wall. Shock absorbing formations—typically, notches—are formed in the bridge portion of the sidewall. These notches have a degree of elasticity such that, when the packaging structure is loaded and then unloaded, or shocked and then unloaded, the notch will return to its original shape and can absorb multiple loads without deteriorating. However, in order for the elasticity to exist, a material with a high degree of stiffness must be used—typically, that material is high density polyethylene. The patent requires that the inboard wall is shorter than the outboard wall.

Another patent issued to Foos et al. is U.S. Pat. No. 5,385,232. This patent also teaches a sidewall structure which forms an enclosure around a platform portion. However, the teachings of this patent also address the issue of light shock loads that may not deform or compress the shock load formations—the notches that are discussed in the previous Foos et al. patent. Here, the concept of openings which provide for collapsibility and allow for the release of compressed air beneath the package when the package is subject to shock loading, is introduced. These collapsible openings may be located in the platform at various locations, and may have a variety of shapes. Still, like the other Foos et al. patent, the teaching is directed to the use of inboard and outboard walls as well as the use of the shock formations (the notches) that have an elastic characteristic.

MOREN et al. U.S. Pat. No. 5,515,976 teaches a structure which has side flanges that are adapted to contact all sides of an end portion of a fragile article, and is thus configured as an end cap. There are a number of protrusions disposed throughout the sidewalls to support the article. There is also a notch provided in the side wall as a means to absorb shock loads. The end cap of this patent is also provided with at least one crush button for absorbing shocks applied along the longitudinal length of the fragile article.

Two related patents issued to DICKIE et al., U.S. Pat. No. 5,626,229 and No. 5,628,402 each are directed to a gas-containing product supporting structure which takes the form of a plastic bladder shaped on one side to provide a cavity having internal dimensions which match the external dimensions of the product to be protected, and shaped on its other side to have external dimensions which match the internal dimensions of the shipping container into which it is placed. The product is semi-rigid and self-supporting, monolithic, and gas-containing and may take the form of a corner piece or an end piece or tray for the product to be protected. The semi-rigid and self-supporting gas-containing bladder will retain its shape irrespective of whether it is sealed or open to the ambient surroundings; and will generally comprise a plurality of chambers in the interior of the product supporting structure with gas communication between the chambers so that the gas that is within the structure may flow from one chamber to another during shock loading circumstances of operation.

AZELTON et al. U.S. Pat. No. 5,799,796 teaches a unitary spring system end cap packaging unit. Here, the structure includes an inner wall, an outer wall, and a spring system disposed between them. The spring system includes at least one flexible harmonic bellows which forms a flexible ridge that has an arcuate shape along the length of the sidewall structure. A cushioning space exists between the edge of the inner sidewall and the edge of the outer sidewall. Dimples may be provided on the inner surfaces of the sidewall to allow a friction fit of the end cap to the product over which it will be placed. The arcuate harmonic bellows form flexible ridges that are elastic in nature; and each bellows of the spring system operates independently when a shock load is applied.

A co-pending United States patent application in the name of the inventor herein, Ser. No. 09/286,843, filed Apr. 6, 1999, teaches a cushioning device which has a molded post as an integral part thereof. The post is designed to extend into an intersecting corner between two perpendicular packaging container sides, or into the corner formed by three mutually perpendicular packaging container sides. A product supporting surface is spaced away from a related packaging container side by a container contacting flange and a curved ridge. In a shock loading situation, the curved ridge will at least temporarily be further curved away from the post, and the product supporting surface will at least temporarily move closer to it's related packaging container side.

Two additional co-pending applications in the name of the present inventor are Canadian Patent Application Serial No. 2372480 which particularly teaches protective packaging enclosures which are formed as a clamshell, into which shock sensitive devices such as hard drives, CD and DVD drives, motherboards, etc., can be placed; and U.S. patent application Ser. No. 09/490,848 filed Jan. 24, 2000, which teaches unitary product cushioning structures which may have a variety of configurations such as caps, edge pieces, trays, and the like. The latter application provides shock absorption support for shock sensitive products in at least two of three mutually perpendicular directions, typically in all three, by the provision of an outer container contacting wall at each side which is intended to contact an outer packaging container.

The present inventor has unexpectedly discovered that an inexpensive moldable plastics material may be employed in the production of end caps in keeping with the present invention, where the end caps have a plurality of deflection elements which extend diagonally away from the corners of a product receiving cavity. Thus, contrary to some of the prior art discussed above, contact with an outer packaging container occurs only at the ends of the container, and in the corners of the container at the ends, rather than at the end walls and outer top and bottom and side walls of the outer packaging container.

SUMMARY OF THE INVENTION

Accordingly, the present invention provides a unitary protective packaging device for shock sensitive products which are shipped or stored in an outer packaging container, with the intention that a pair of such unitary protective packaging devices will be employed, one at each end of a shock sensitive product, and with the understanding that the outer packaging container is rectilinear in configuration.

The unitary packaging device comprises a product receiving cavity which is surrounded by product contacting walls, and where the product receiving cavity has a product supporting platform in the lower region thereof.

There is a base portion below the product receiving cavity, which has two pairs of deflection elements extending diagonally away from the corners of the product receiving cavity towards external outer packaging container contacting corners. Also, the base portion has bottom outer packaging container contacting lips at the bottom side thereof.

The distances between adjacent pairs of outer packaging container contacting corners are substantially equal to but not greater than the internal distances between adjacent pairs of corners of the inner packaging container with which the unitary protective packaging devices are to be employed.

The pairs of deflection elements are adapted to flex away one from another under shock loading conditions, and the bottom outer packaging container contacting lips are adapted to spread away one from another under shock loading conditions.

Accordingly, shock protection for a shock sensitive product in an outer packaging container, and having a unitary protective packaging device at each end thereof, is provided in three mutually perpendicular directions.

Typically, the configuration of the product receiving cavity of the unitary protective packaging device in keeping with the present invention, is rectilinear.

In some embodiments of the present invention, a U-shaped channel may be formed around the periphery of the product supporting platform.

Also, in some embodiments of the present invention, the product supporting platform may be formed having an upwardly curved configuration.

Typically, the product receiving cavity has a rectangular configuration, with one pair of opposed product contacting walls being longer than the other pair of product contacting walls.

Also, typically a downwardly directed notch may be formed in each of the longer product contacting walls.

In any event, a downwardly directed notch may be formed in at least one pair of opposed product contacting walls.

Each of the deflection elements is formed at least at the external outer packaging container contacting corners thereof so as to slope downwardly and outwardly towards the bottom outer packaging container contacting lips.

Also, the bottom outer packaging container contacting lips may be formed so as to extend outwardly from the base portion in the bottom region thereof.

When the product receiving cavity has a rectangular configuration, there may be an additional outwardly directed stiffening rib which is formed in the base portion between the external outer packaging container contacting corners on the sides of the base portion beneath the longer product contacting walls of the product receiving cavity.

Still further, an outwardly directed stiffening rib may be formed in the base portion between the external outer packaging container contacting corners in each of at least one pair of opposed sides of the base portion.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
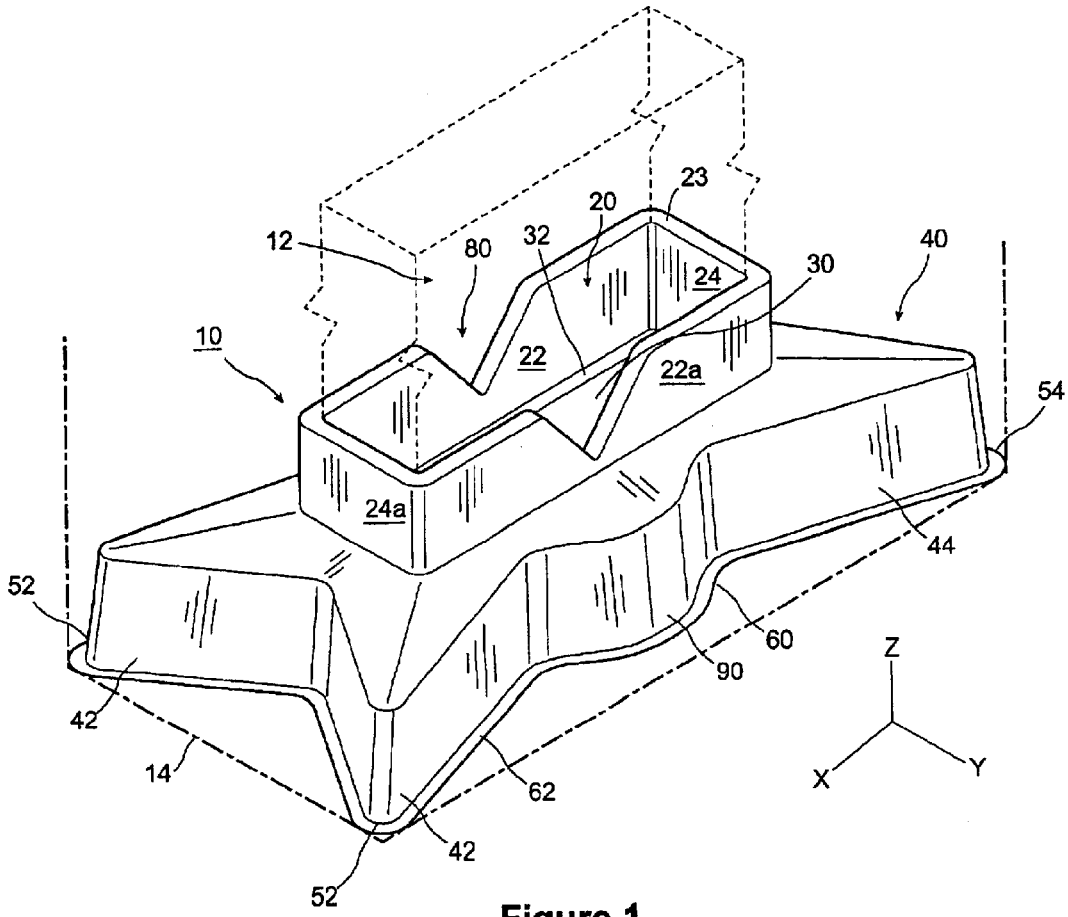
FIG. 1 is a perspective view of a typical embodiment of a unitary protective packaging device in keeping with the present invention, when viewed from the top.

Turning first to FIG. 1, there follows some discussion to introduce some of the basic concepts and premises surrounding design and function of unitary product cushioning structures in keeping with the present invention, and to introduce the terminology which is particularly employed herein.

A typical unitary product cushioning structure in keeping with the present invention is shown at 10 in FIG. 1. The product cushioning structure 10, as can be understood from FIG. 1, has a general configuration of an end cap, in that it is intended to fit over the end of a shock sensitive product which is shown generally at 12. It will also be understood that the unitary product cushioning device 10, in keeping with the present invention, is also intended to be used in conjunction with an outer packaging container whose inside corners at one end thereof are indicated generally at 14.

The unitary protective packaging device 10 has a product receiving cavity 20, which has a generally rectilinear configuration. The product receiving cavity 20 is defined by pairs of opposed product contacting walls 22 and 24, and outside walls 22*a* and 24*a*, discussed hereafter. The shock sensitive device 12 may have a square configuration, but typically such devices are rectangular in cross-section, as indicated in FIG. 1. Thus, it can be well understood that for such rectilinear shock sensitive devices, a pair of end caps or unitary protective packaging devices 10 in keeping with present invention can be employed together with a rectilinear outer packaging container 14 for shipping and storing the shock sensitive device 12.

The product receiving cavity 20 is subtended at its bottom end by a product supporting platform 30. As will be noted hereafter, the product supporting platform 30 may be surrounded at its periphery by a U-shaped channel 32. Moreover, the product supporting platform 30 may be formed so as to have an upwardly curved configuration, as indicated in FIG. 1.

In some special cases, however, it is also possible that the product supporting platform 30 may be formed so as to have a concave configuration, so as to accommodate a shock sensitive device which has a convex outer surface at the end thereof which is to be fitted into and accommodated by the product receiving cavity 20. In some cases, typically the plane configuration of the product receiving cavity 20 is rectangular, but the overall configuration would not be rectilinear because of the concave product supporting platform.

Figure 2:
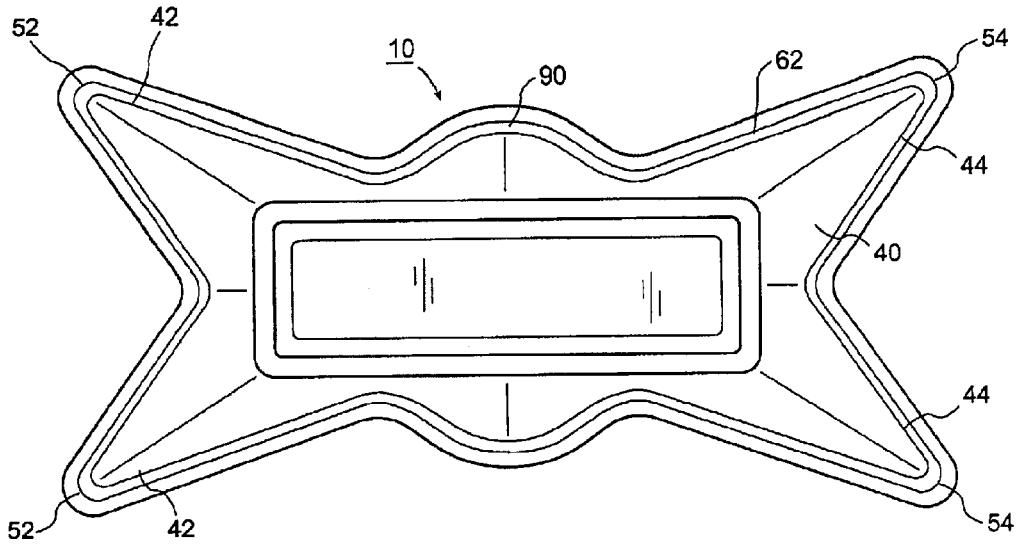
FIG. 2 is a top view of a typical embodiment of the unitary protective packaging device in keeping with FIG. 1.

Below the product receiving cavity 20 there is a base portion which is shown generally at 40. The base portion 40 has two pairs of deflection elements 42 and 44, located at the left and right ends of the unitary protective packaging device 10, as seen in each of FIGS. 1, 2, and 3. It will also be understood that each of the deflection elements 42 and 44 is such that it extends diagonally away from a respective corner of the product receiving cavity 20. This can be understood particularly by inspection of FIGS. 1 and 2.

Each of the deflection elements 42 and 44 is defined at its outer end by a respective external outer packaging container contacting corner 52 or 54. It will be understood particularly from an inspection of FIG. 1 that the outer packaging container contacting corners 52 and 54 fit into the corners of the outer packaging container 14.

The base portion 40 also has bottom outer packaging container contacting lips 60 which are intended to contact a bottom or end wall of the outer packaging container 14, depending on its orientation, but understood to be a bottom wall as seen in FIG. 1. Typically, the bottom outer packaging container contacting lips 60 are formed so as to extend outwardly away from the base portion 40, as shown at 62 in FIGS. 1 and 2.

It will be understood, of course, that the discussion of "top", "bottom", "above", "below", and similar orientation language, is in respect of the manner in which the present invention is illustrated and shown in the drawings which accompany this description.

It will also be understood that shock protection for any shock sensitive product which is to be provided by unitary protective packaging devices in keeping with present invention is intended to be in any or all of three mutually perpendicular directions. They are shown in FIG. 1 as being in the "X", "Y", and "Z" directions 72, 74, and 76, respectively.

Figure 3:
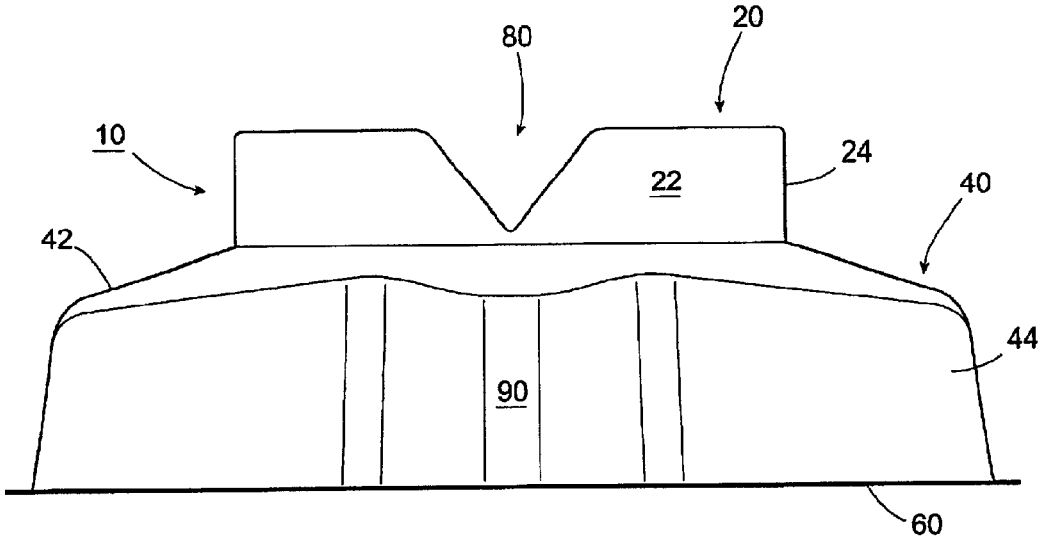
FIG. 3 is a side view of the unitary protective packaging device in keeping with FIG. 1.

A pair of notches 80 may be formed in the longer product contacting walls 22 of the product receiving cavity 20, as seen in FIGS. 1 and 3, in particular. The notches 80 actually provide stiffness to the product contacting walls 22. This is because, typically, unitary protective packaging devices in keeping with present invention are thermoformed such as by being vacuum formed; and accordingly, the product contacting walls 22 and 24 have outer walls 22*a* and 24*a* in parallel with them, joined by a ridge 23 which extends between them.

Of course, it will be understood that the notches 80 may be formed as well, or instead of, in the product receiving walls 24, 24*a*. Moreover, when the product receiving cavity 20 has a plane configuration which is square, then notches 80 may be formed in all four product receiving walls 22, 22*a* and 24, 24*a*.

It will be understood from FIGS. 1 and 3, in particular, that the outer extremities is of the deflection elements 42 and 44 are formed so as to slope downwardly and outwardly. This will assure proper functioning of the unitary protective packaging devices in keeping with present invention, as well as to provide for easy removal of the molded unitary protective packaging devices from the molds after they have been vacuum formed.

A further pair of outwardly directed stiffening ribs 90 may also be formed in the unitary protective packaging device 10, particularly on the long sides thereof, so as to be beneath the longer outer walls 22, 22*a*.

Moreover, the stiffening ribs 90 may be as well, or instead of, in the base portion 40 in the region beneath the outer walls 24*a*; or when the product receiving cavity 20 has a plan configuration which is square, then the stiffening ribs 90 may be formed in the base portion 40 below all of the outer walls 22*a*, 24*a*.

In use, it will be understood that a pair of unitary protective packaging devices 10, in keeping with present invention, may be placed at each end of a shock sensitive product 12 within an outer packaging container 14. If the container having a shock sensitive product 12 therein is dropped in the direction of the "Z" axis, as seen in FIG. 1, then it will be understood that the momentum of the shock sensitive product 12 will act downwardly against the product supporting platform 30, and forces will be transmitted from the product receiving cavity 20 to the base portion 40 and thence to the bottom outer packaging container contacting lips 60. Also, the upwardly curved product supporting platform 30, and the U-shaped channel surrounding it, when present, provide additional shock absorption elements to absorb energy due to the downward momentum of the shock sensitive product 12 in such "Z" axis drop.

If a drop is made in the direction of the "Y" axis, then it will be seen that one of each of the deflection elements 42 and 44 will tend to flex away from the other—in other words, the respective adjacent pair of deflection elements will flex away one from the other. Of course, interference at the respective outer packaging container contacting corners with the outer packaging container 14 will preclude substantial flexing of the deflection elements, and thus there will be a controlled deceleration of the shock sensitive product 12 as its momentum is absorbed by the respective deflection elements 42 and 44.

Likewise, if a drop is made in the direction of the "X" axis, then a respective pair of deflection elements 42 or 44 will absorb the momentum forces transferred to them during deceleration of the shock sensitive product 12.

Of course, it will be understood that most drops will result in compound deceleration in at least two of the three mutually perpendicular axes, as shown in FIG. 1. Accordingly, unitary protective packaging devices in keeping with present invention will function to provide shock protection for shock sensitive products in the three mutually perpendicular directions, or any one or two of them at any one time.

Particularly when the unitary protective packaging device 10 of the present invention is thermoformed from a sheet plastics material, particularly such as by vacuum forming, the compression strength of the molded unitary structure, and thereby its ability to withstand shock forces, may vary as a function of the thickness of the thermoformable sheet plastic material, from which the unitary protective packaging device has been thermoformed. For example, similar designs of unitary protective packaging device manufactured from thermoformable sheet plastics material having an initial thickness of 0.080 inches will vary considerably from those manufactured from thermoformable sheet plastics material having an initial thickness of, for example, 0.100 inches, or 0.050 inches. The decision is, of course, determined as a matter of the knowledge by the designer and by the purchaser of the end purpose to which the unitary protective packaging device will be put. Obviously, shock sensitive products having the same size but weighing two or three times as much as other shock sensitive products will require unitary product cushioning structures which are thermoformed from thicker sheet plastics materials.

Generally, the elasticity of any plastics material from which the unitary protective packaging devices of the present invention are manufactured, is such that there is no permanent deformation of the unitary unitary protective packaging devices when they have been put to the task of absorbing shock loading so as to protect the shock sensitive product that is in them.

To that end, drop tests have indicated the ability of the unitary unitary protective packaging devices of the present invention to meet all drop test standards. Those standards may vary from case to case, depending on the product to be protected, the size and nature of the unitary protective packaging device, the nature of the outer packaging container, and so on. Generally, a unitary product cushioning structure in keeping with the present invention will reduce the forces that are imparted to the shock sensitive product being cushioned, to less than 100 g's. Typically, a level of 50 g's to 60 g's for a drop of about 1 meter is obtained by unitary protective packaging devices in keeping with the present invention.

The molding techniques which may be employed to manufacture unitary product cushioning structures in keeping with the present invention may include thermoforming processes such as drape molding and vacuum molding, in particular.

Typical materials from which unitary product cushioning devices of the present invention may be molded include low density polyethylene, high density polyethylene, polyvinylchloride, PET, polystyrene, nylon, polypropylene, and appropriate mixtures and co-polymers thereof. However, it will be understood that the above list of materials is intended to be illustrative but not exhaustive.

There has been described a unitary unitary protective packaging device which provides excellent shock protection for shock sensitive products.

Other modifications and alterations may be used in the design and manufacture of the apparatus of the present invention without departing from the spirit and scope of the accompanying claims.

The use of the word "substantially" is intended to enhance the scope of the particular characteristic being described. For example, substantially equal is intended to mean equal or almost equal, and/or exhibiting characteristics of equality. Moreover, the word "substantial" may imply a meaning of excessive or superfluous action.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed:

1. A unitary protective packaging device for a shock sensitive product being shipped in an outer packaging container, wherein a pair of said unitary protective packaging devices are employed, one at each end of a shock sensitive product, and an outer packaging container is rectilinear in configuration, said unitary packaging device comprising:

a product receiving cavity surrounded by product contacting walls, and having a product supporting platform in the lower region thereof; and a base portion below said product receiving cavity, having two pairs of deflection elements extending diagonally away from the corners of said product receiving cavity towards external outer packaging container contacting corners, and having bottom outer packaging container contacting lips at the bottom of said base portion;

wherein the distances between adjacent pairs of outer packaging container contacting corners are substantially equal to but not greater than the internal distances between adjacent pairs of corners of the outer packaging container with which said unitary protective packaging device is to be employed; and wherein said pairs of deflection elements are adapted to flex away one from another under shock loading conditions, and said bottom outer packaging container contacting lips are adapted to spread away from one another under shock loading conditions;

whereby shock protection for a shock sensitive product in an outer packaging container and having a unitary protective packaging device at each end thereof, is provided in three mutually perpendicular directions.

2. The unitary protective packaging device of claim 1, wherein said product receiving cavity has a rectilinear configuration.

3. The unitary protective packaging device of claim 2, wherein a U-shaped channel is formed around the periphery of said product supporting platform.

4. The unitary protective packaging device of claim 2, wherein said product supporting platform is formed with an upwardly curved configuration.

5. The unitary protective packaging device of claim 2, wherein said product receiving cavity has a rectangular configuration, with one pair of opposed product contacting walls being longer than the other pair of product contacting walls.

6. The unitary protective packaging device of claim 5, wherein a downwardly directed notch is formed in each of said longer product contacting walls.

7. The unitary protective packaging device of claim 5, wherein a downwardly directed notch is formed in at least one pair of opposed product conducting walls.

8. The unitary protective packaging device of claim 1, wherein each of said deflection elements is formed at least at said external outer packaging container contacting corners so as to slope downwardly and outwardly.

9. The unitary protective packaging device of claim 1, wherein said bottom outer packaging container contacting lips extend outwardly from said base portion.

10. The unitary protective packaging device of claim 5, wherein an outwardly directed stiffening rib is formed in said base portion between said external outer packaging container contacting corners on the sides of said base portion beneath said longer product contacting walls.

11. The unitary protective packaging device of claim 4, wherein an outwardly directed stiffening rib is formed in said base portion between said external outer packaging container contacting corners in each of at least one pair of opposed sides of said base portion.

* * * * *